US006793594B1

(12) United States Patent
Grant

(10) Patent No.: US 6,793,594 B1
(45) Date of Patent: Sep. 21, 2004

(54) SPORTS PRACTICE NET

(75) Inventor: Eugene Grant, Reno, NV (US)

(73) Assignee: Athletic Training Equipment Company, Inc., Sparks, NV (US)

( * ) Notice: Subject to any disclaimer, the term of this patent is extended or adjusted under 35 U.S.C. 154(b) by 0 days.

(21) Appl. No.: 10/397,271

(22) Filed: Mar. 27, 2003

(51) Int. Cl.[7] ..... A63B 63/00
(52) U.S. Cl. ..... 473/476; 473/478; 434/247
(58) Field of Search ..... 434/247, 251, 434/252; 473/197, 476, 477, 478

(56) References Cited

U.S. PATENT DOCUMENTS

| | | | | | |
|---|---|---|---|---|---|
| 849,941 | A | | 4/1907 | Titus | |
| 920,907 | A | | 5/1909 | Bolton | |
| 2,899,208 | A | | 8/1959 | Wallsteiner | |
| 3,049,353 | A | | 8/1962 | Viator | |
| 3,197,208 | A | | 7/1965 | Makar | |
| 4,045,032 | A | | 8/1977 | Cox | |
| 4,063,739 | A | | 12/1977 | La Rose | |
| 5,088,740 | A | | 2/1992 | Peterson | |
| 5,244,213 | A | | 9/1993 | Armell | |
| 5,269,527 | A | | 12/1993 | Noval | |
| 5,467,990 | A | * | 11/1995 | Kitzhaber | 473/164 |
| 5,609,528 | A | * | 3/1997 | Kehoe | 473/157 |
| 5,690,339 | A | | 11/1997 | Chen | |
| 5,730,442 | A | * | 3/1998 | Anderson | 273/400 |
| 5,823,885 | A | * | 10/1998 | Stempfer | 473/197 |
| 6,319,145 | B1 | * | 11/2001 | Coughlan | 473/197 |
| 6,352,480 | B1 | | 3/2002 | Macaluso | |
| 6,485,373 | B1 | * | 11/2002 | Stephens | 473/197 |
| 6,517,444 | B1 | * | 2/2003 | Yoon | 473/197 |
| 6,554,717 | B2 | * | 4/2003 | Cho | 473/197 |
| 2002/0030324 | A1 | | 3/2002 | Macaluso | |
| 2002/0049092 | A1 | | 4/2002 | Yoon | |

OTHER PUBLICATIONS

ATEC (Athletic Training Equipment Company, Inc.) Baseball/Softball Catalog 2003.

* cited by examiner

*Primary Examiner*—Kurt Fernstrom
(74) *Attorney, Agent, or Firm*—Jacobson Holman; Terence P. O'Brien

(57) ABSTRACT

A free standing net system incorporates a full sized floor for easy ball collection and a built in training target secured to a rear wall of a netted enclosure which is functional for multi-sport use. The netting of the enclosure is 1000 denier polyester, treated for long wear and UV resistance. The floor is constructed of high density nylon with a water-resistant polyurethane coating. The sleeves located at the peripheral edges of the netting are engaged by two shock-corded poles to provide a cantilevered frame portion projecting above and towards the sports enthusiast. The cantilevered frame portion is specifically designed to trap wedge shots during golf practice. Angled side wings of the netted enclosure allow free swinging motion with any golf club to provide a wide angle of capture during golf practice swings.

24 Claims, 5 Drawing Sheets

SPORTS PRACTICE NET

FIELD OF THE INVENTION

The present invention relates to a sports practice net for use in practicing golf, baseball, softball, soccer, football and tennis, for example.

BACKGROUND OF THE INVENTION

With increased leisure time and increased competition in sports for both children and adults, there is ever increasing pressure to be proficient in many fields of sport.

When not partaking of sports, it is often desirable to practice the fundamentals of the game for at least limited time periods. This should be able to be accomplished without entering a field of competition or require all of the equipment necessary to play the game, such as extensive areas of space or defined fields of play.

Accordingly, to achieve the goals of the present invention, a portable sports practice net should be able to be quickly assembled in limited areas of space to facilitate practicing of a particular sport.

SUMMARY OF THE INVENTION

By the present invention, a collapsible sports practice net facilitates practicing of a particular sport whether it be golf, baseball, softball, soccer, football or tennis, for example. This may be accomplished by the use of a shock-corded frame having two fiberglass shock-corded poles engageable within two nylon sleeves of the sports practice net for quick and easy assembly.

The free standing net system incorporates a full sized floor for easy ball collection and a built in training target secured to a rear wall of a netted enclosure which is functional for multi-sport use. The netting of the enclosure is 1000 denier polyester, treated for long wear and UV resistance. The floor is constructed of high density nylon with a water-resistant polyurethane coating.

The sleeves located at the peripheral edges of the netting are engaged by two shock-corded poles to provide a cantilevered frame portion projecting above and towards the sports enthusiast. The cantilevered frame portion is specifically designed to trap wedge shots during golf practice. Angled side wings of the netted enclosure extending from opposite sides of a rear wall allow free swinging motion with any golf club to provide a wide angle of capture during golf practice swings.

The frame encloses over 200 square feet of ball restraining netting. Freedom is provided to take a full golf swing while avoiding concern for over-hitting the ball. Substantially all golf swing practice shots will be restrained by the frame assembly of the present invention. Ground stakes may be used to anchor the frame assembly during windy conditions.

Accordingly, it is an object of the present invention to provide a collapsible frame assembly which is easily assembled to provide a sports practice net.

It is another object of the present invention to provide a collapsible frame assembly which is easily assembled to provide a sports practice net with the frame assembly including a cantilevered frame section and two angled side wings allowing for free swinging of any golf club.

It is still yet another object of the present invention to provide a collapsible frame assembly which is easily assembled to provide a sports practice net with the frame assembly including a cantilevered frame section and two angled side wings assembled by sliding engagement of two shock-corded poles in sleeves located at a periphery of the netting of the frame assembly.

It is still yet another object of the present invention to provide a collapsible frame assembly which is easily assembled to provide a sports practice net with the frame assembly including a cantilevered frame section and two angled side wings assembled by sliding engagement of two shock-corded poles in sleeves located at a periphery of the netting of the frame assembly and having an integral target at a rear wall of the frame assembly.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
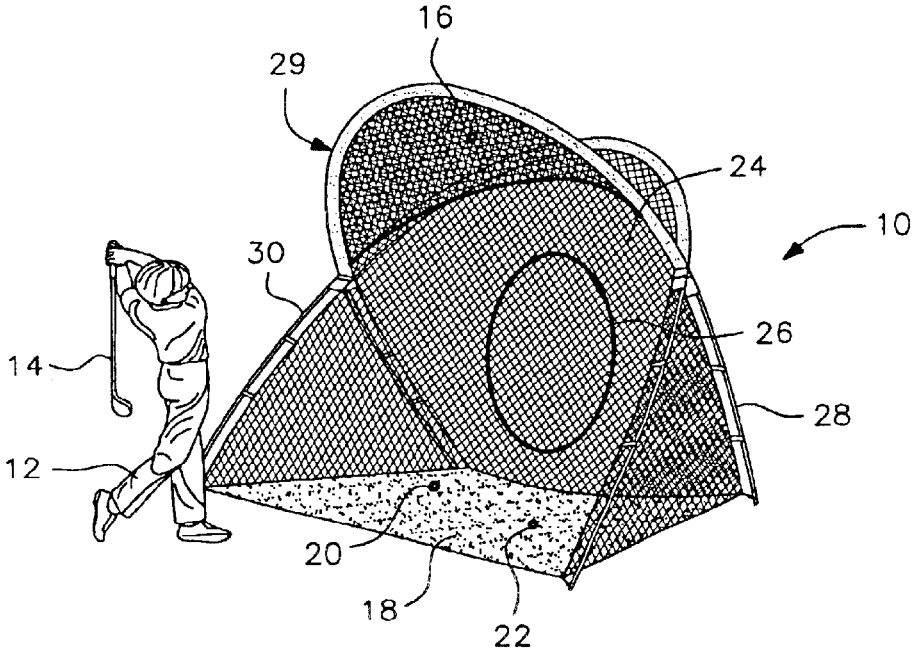
FIG. 1 illustrates the sports practice net of the present invention being used to practice a golf swing.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 5 in particular, a sports practice net embodying the teachings of the subject invention is generally designated as 10. With reference to its orientation in FIG. 1, the sports practice net is being used by a golfer 12 swinging a club 14 to loft a ball 16 into the air. After contacting the net 10, the ball will fall to the floor section 18 as evidenced by other balls 20, 22.

As shown in more detail in FIGS. 2 through 5, the overall dimensions of the assembled sports practice net 10 include a width A of approximately 12 feet, a height B of approximately nine feet and a depth D of approximately six feet. The rearmost portion of the floor section 18 has a width C of approximately six feet. At a rear wall 24 of the frame assembly is an integral driving target 26 for assisting in aiming a ball at a specific location on the rear wall 24. The rear wall is coupled to the floor section.

Figure 4:
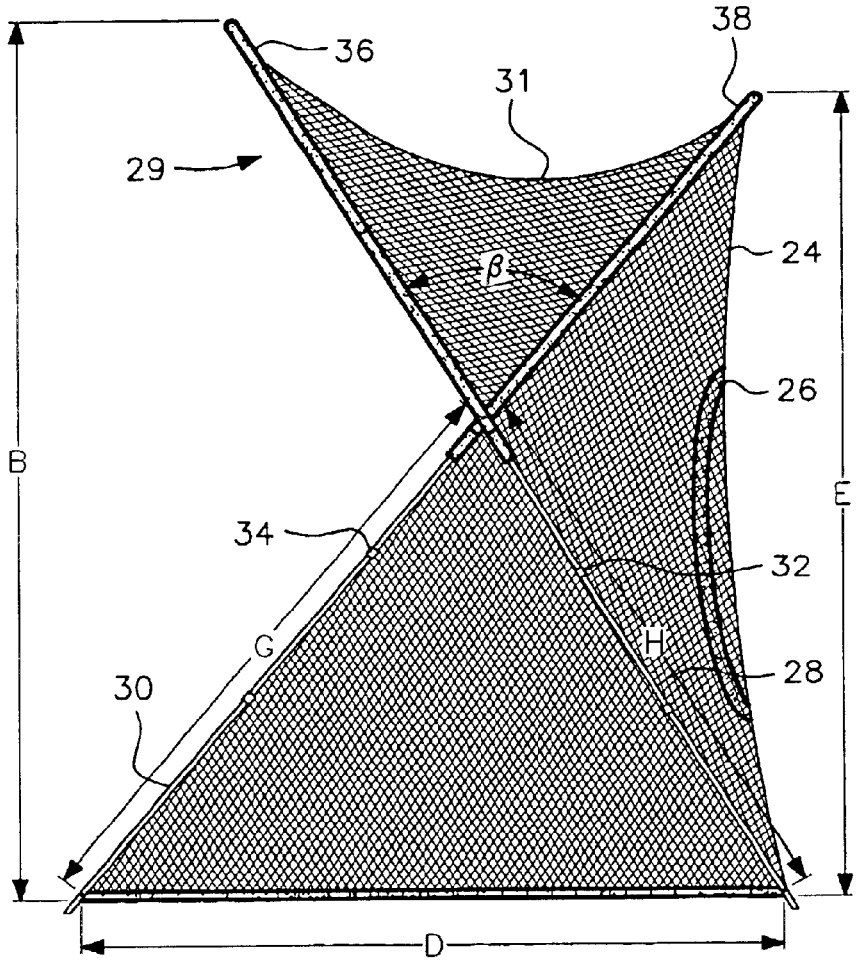
FIG. 4 is a side view of the assembled sports practice net of the present invention illustrating the cantilevered frame portion extending up and away from a sports practice target located at a rear wall of the frame assembly.

As best shown in FIG. 4, the frame assembly includes two shock-corded non-closed, arched poles 28, 30. These poles are threaded through a series of loops 32, 34, respectively, before engaging in sleeves 36, 38, respectively. The loops 32 and sleeve 36 are similarly color coded to aid in proper threading of the shock-corded poles into position. Loops 34 and sleeve 38 are of the same color but of different color from the loops 32 and sleeve 36 to differentiate the threading path for the other pole 30. The first pole 28 has first and second ends which terminate at a rear edge of the floor section.

After insertion of the poles through their respective loops and sleeve, the pole 28 forms a forwardly projecting, cantilever frame portion 29, particularly useful in trapping golf wedge shots. The rearward extending pole 30 helps in supporting the rear wall section 24 having the target 26. A section 31 of the netting is draped to curve downwardly between the poles 28 and 30. As shown in FIG. 4, the poles 28, 30, cross at an angle β of approximately 70 degrees.

Figure 3:
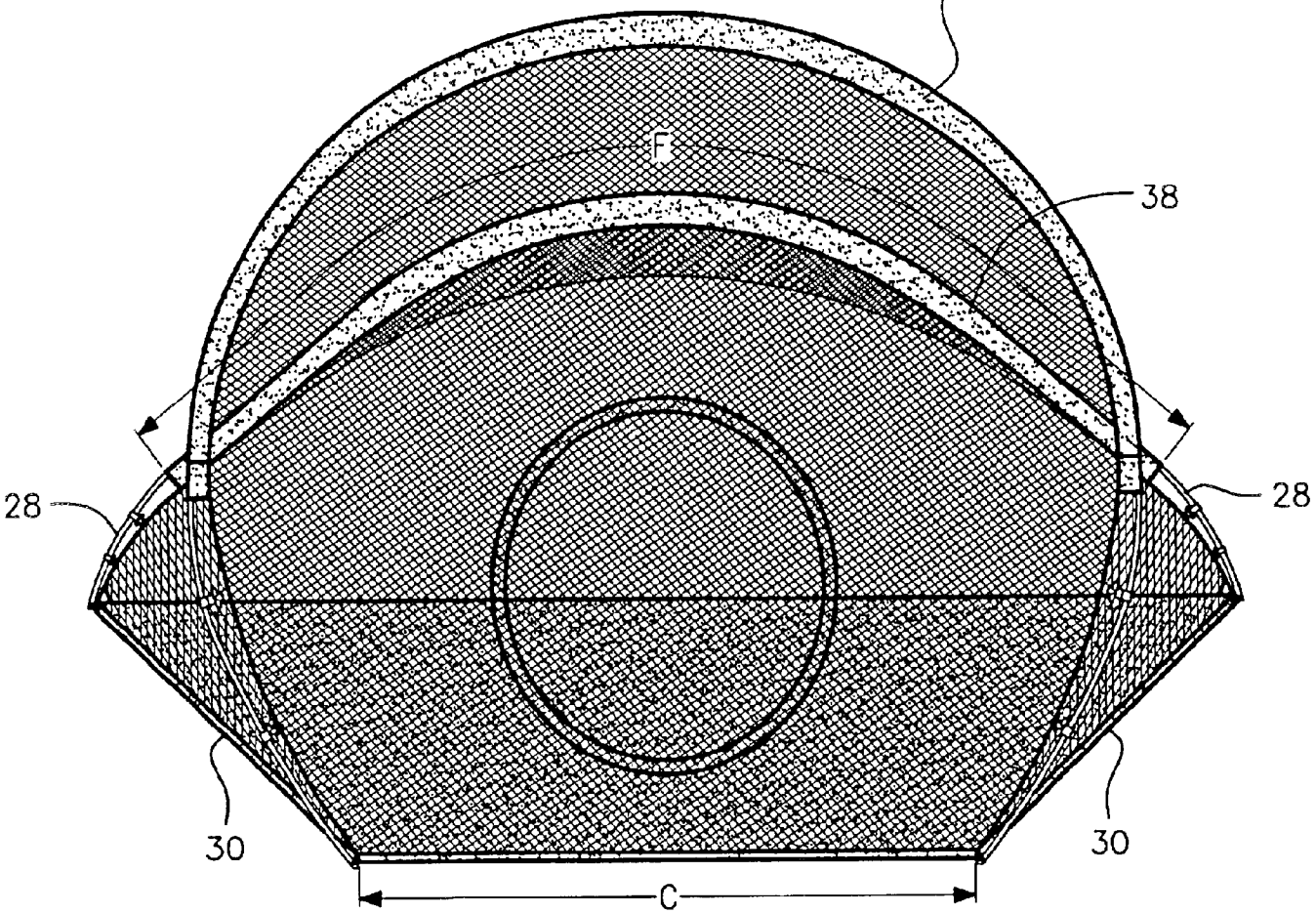
FIG. 3 is a rear perspective view of the present invention.
Figure 5:
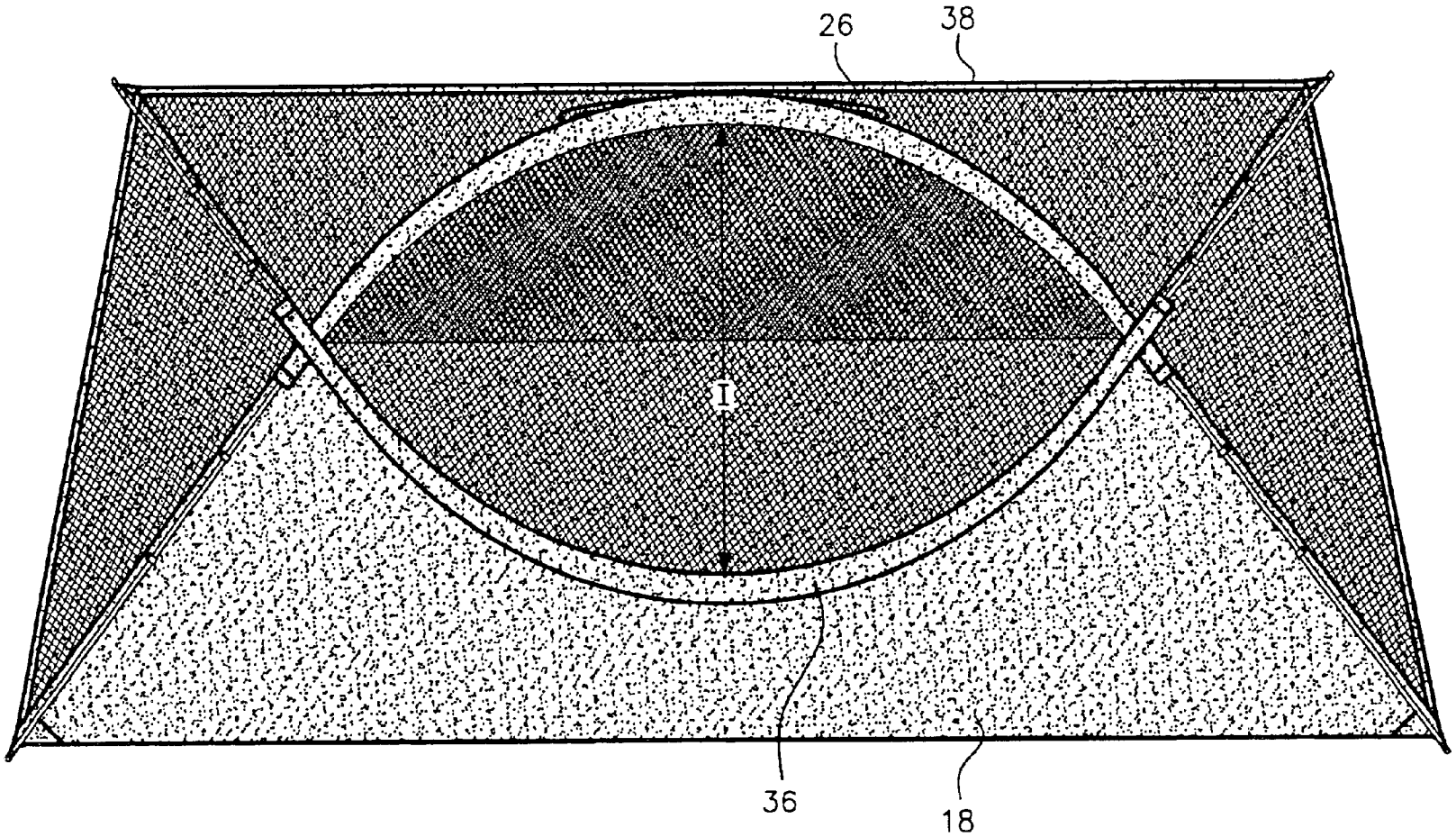
FIG. 5 is a top plan view of the sports practice net.

The height E of the uppermost portion of pole 30 extending through sleeve 38 is approximately eight feet. The length G of pole 30 from the floor section 18 to its intersection with pole 28 is approximately five feet. Similarly, the height H of pole 28 to the intersection with pole 30 is approximately five feet. Also, the length F of sleeve 38 as shown in FIG. 3 is approximately 14 feet. The separation I of the sleeves 36, 38 in section 31 as shown in FIG. 5 is approximately six feet.

Extending forwardly from the rear wall 24 are opposed wing sections 40 and 42 having a bottom length of approximately six feet as well as a height along the rear wall section of approximately six feet and extending above the floor section at its forwardmost edge for approximately six feet. The wing sections 40, 42 diverge from the rear wall section 24 by an oblique angle α of approximately 145 degrees.

Figure 6:
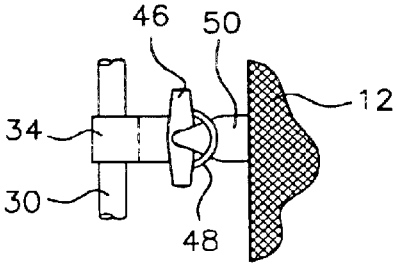
FIG. 6 is an enlarged view of the area encircled and labeled as FG6 in FIG. 2.
Figure 7:
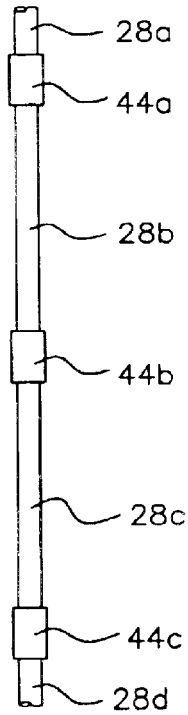
FIG. 7 is an enlarged view of the area encircled and labeled as FG7 in FIG. 2.

With reference to FIGS. 6 through 9, additional details of the frame assembly are shown. In FIG. 7, shock cord sections 28*a*, 28*b*, 28*c*, 28*d* are shown interconnected by couplings 44*a*, 44*b*, 44*c*. Running through the hollow interior of the shock cord sections is an elastic cord such that the shock cord sections may be disengaged from interconnecting couplings 44*a*, 44*b*, 44*c* by movement of the shock cord sections away from each other. For interconnection of the sections 28*a*, 28*b*, 28*c*, 28*d*, while overcoming the resistance of the internal elastic cord passing through the interior of the sections, the various shock cord sections are positioned in the couplings and are held in place by the elasticity of the internal elastic cord.

In FIG. 6, shock cord pole 30 is shown extending through loop 34 which is connected to wing section 42, for example. The connection of the pole 30 to the wing section 42 is accomplished by passing a toggle 46 through a D-ring 48 with an end of the loop so interconnected between the wing section 42 and toggle 46. Similarly, the loop 34 terminates at one end in D-ring 48 with the opposite end being secured to the wing section 42. The pole 30 is thereby retained in position prior to entry into elongated sleeve 36 (with reference to pole 30).

Figure 8:
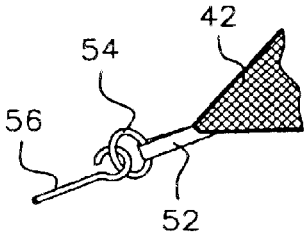
FIG. 8 is an enlarged view of the area encircled and labeled as FG8 in FIG. 2.

FIG. 8 illustrates a corner of wing section 42 interconnected by loop 52 to a ring 54. A steel ground stake 56 may engage the ring 54 for anchoring the frame assembly during high wind conditions.

Figure 9:
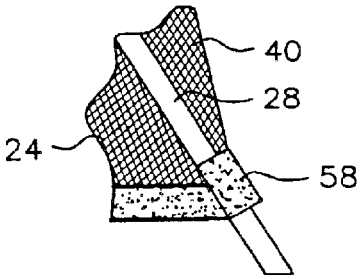
FIG. 9 is an enlarged view of the area encircled and labeled as FG9 in FIG. 2.
Figure 2:
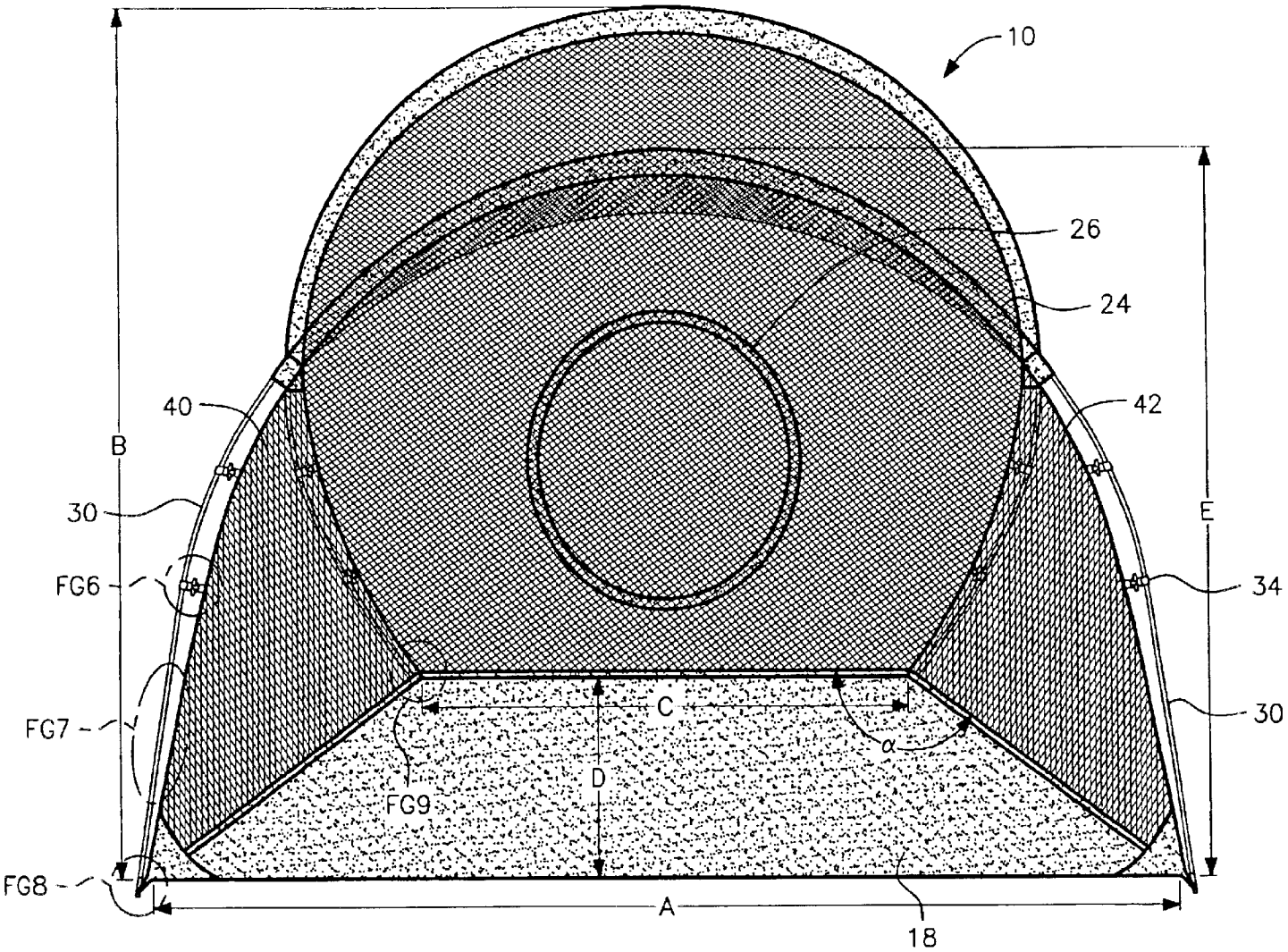
FIG. 2 is a front view of the sports practice net of the present invention in an assembled condition.

In FIG. 9, the end of pole 28, adjacent to rear wall 24, is shown secured within loop 58 for anchoring the pole 28. A steel ground stake arrangement as shown in FIG. 8 may be implemented if necessary due to high wind conditions.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A collapsible sports practice net comprising:

a floor section, an enclosure formed of netting located above said floor section, said netting including a rear wall, first and second wing sections extending laterally from said rear wall and a cantilevered portion projecting forwardly from said rear wall and terminating in a free end above said floor section, the rear wall having a lower portion which is coupled to the floor section, the first and second wing sections forming opposing first and second oblique angles, respectively, with the rear wall at the floor section, and at least first and second non-closed support poles engaging the netting.

2. A collapsible sports practice net as claimed in claim 1, wherein the first support pole extends through a sleeve located at said free end of said cantilevered portion.

3. A collapsible sports practice net as claimed in claim 2, wherein the first pole includes first and second ends, and wherein the first and second ends of the first pole terminate at a rear edge of said floor section.

4. A collapsible sports practice net as claimed in claim 1, wherein the rear wall extends to a first height, wherein the free end extends to a second height, and wherein the second height is greater than the first height.

5. A collapsible sports practice net as claimed in claim 4, wherein the second height is nine feet.

6. A collapsible sports practice net as claimed in claim 4, wherein the first height is eight feet.

7. A collapsible sports practice net as claimed in claim 2, wherein the first pole extends through a plurality of loops and said sleeve to support said netting.

8. A collapsible sports practice net as claimed in claim 2, wherein the second support pole extends from a front edge of said floor section to an upper edge of said rear wall.

9. A collapsible sports practice net as claimed in claim 1, wherein the first and second wing sections extend between the first and second support poles and said floor section.

10. The sports practice net of claim 1, wherein each of the first and second wings forwardly and laterally extend from the rear wall.

11. The sports practice net of claim 1, wherein the rear wall extends to a first height, wherein the first and second support poles intersect each other, at a third height, and wherein the third height is greater than 50 percent of the first height.

12. The sports practice net of claim 1, wherein each of the first and second support poles are arched.

13. The sports practice net of claim 1, wherein the first and second support poles are segmented shock-corded poles.

14. The sports practice net of claim 1, wherein the floor section forms a first rear corner with the rear wall and the first wing section, and wherein the floor section forms a second rear corner with the rear wall and the second wing section.

15. A collapsible sports practice net comprising:

an enclosure formed of netting and including a rear wall, two wing sections extending laterally from opposite sides of said rear wall and a cantilevered portion projecting forwardly from said rear wall and terminating in a free end, and exactly two, non-closed arched support poles threaded through said enclosure for supporting the enclosure above the ground.

16. A collapsible sports practice net as claimed in claim 15, wherein one of said support poles extends through a sleeve located at said free end of said cantilevered portion.

17. A collapsible sports practice net as claimed in claim 16, wherein said one pole terminates at a bottom edge of said rear wall.

18. A collapsible sports practice net as claimed in claim 15, wherein said rear wall extends to a first height below said free end.

19. A collapsible sports practice net as claimed in claim 16, wherein said one pole extends through a plurality of loops and said sleeve to support said netting.

20. A collapsible sports practice net as claimed in claim 19, wherein said plurality of loops and said sleeve are the same color.

21. A collapsible sports practice net as claimed in claim 15, wherein two of said support poles cross each other.

22. A collapsible sports practice net as claimed in claim 21, wherein said two support poles cross at an angle of 70°.

23. The sports practice net of claim 21, wherein the rear wall extends to a first height, wherein the two support poles cross, or intersect, at a second height, and wherein the second height is greater than 50 percent of the first height.

24. The sports practice net of claim 15, wherein the support poles are segmented shock-corded poles.

* * * * *